US009238567B2

(12) United States Patent
Jones

(10) Patent No.: US 9,238,567 B2
(45) Date of Patent: Jan. 19, 2016

(54) STITCHING SECTIONS OF A TABLOID NEWSPAPER

(71) Applicant: Goss International Americas, Inc., Durham, NH (US)

(72) Inventor: Jackson Hacker Jones, Rochester, NH (US)

(73) Assignee: Goss International Americas, Inc., Druham, NH (US)

( * ) Notice: Subject to any disclaimer, the term of this patent is extended or adjusted under 35 U.S.C. 154(b) by 17 days.

(21) Appl. No.: 14/141,157

(22) Filed: Dec. 26, 2013

(65) Prior Publication Data

US 2014/0183807 A1 Jul. 3, 2014

Related U.S. Application Data

(60) Provisional application No. 61/747,754, filed on Dec. 31, 2012.

(51) Int. Cl.

| | |
|---|---|
| ***B65H 37/04*** | (2006.01) |
| ***B42B 4/00*** | (2006.01) |
| ***B41F 13/66*** | (2006.01) |
| ***B42C 3/00*** | (2006.01) |
| ***B42C 5/00*** | (2006.01) |
| ***B42D 7/00*** | (2006.01) |
| ***B26F 1/02*** | (2006.01) |
| ***B41F 13/56*** | (2006.01) |
| ***B41F 13/60*** | (2006.01) |
| *B42C 1/12* | (2006.01) |

(52) U.S. Cl.

CPC *B65H 37/04* (2013.01); *B26F 1/02* (2013.01); *B41F 13/56* (2013.01); *B41F 13/60* (2013.01); *B41F 13/66* (2013.01); *B42B 4/00* (2013.01); *B42C 3/00* (2013.01); *B42C 5/00* (2013.01); *B42D 7/00* (2013.01); *B42C 1/12* (2013.01)

(58) Field of Classification Search

CPC ..... B42C 1/12; B41F 13/66; B26F 1/04; B42B 4/00; B42B 4/02; B65H 37/04

See application file for complete search history.

(56) References Cited

U.S. PATENT DOCUMENTS

| | | | | |
|---|---|---|---|---|
| 5,290,020 | A * | 3/1994 | Matsui | B42B 4/00 227/111 |
| 6,962,280 | B2 | 11/2005 | Kaya | |
| 7,364,148 | B2 | 4/2008 | Herbert | |
| 7,588,240 | B2 | 9/2009 | Guaraldi et al. | |
| 7,775,511 | B2 | 8/2010 | Lee | |

(Continued)

FOREIGN PATENT DOCUMENTS

| | | |
|---|---|---|
| EP | 2 039 640 | 8/2003 |

*Primary Examiner* — Jennifer Simmons

(74) *Attorney, Agent, or Firm* — Davidson, Davidson & Kappel, LLC

(57) ABSTRACT

A method for forming a printed product is provided. The method includes the steps of providing a first section and a second section of the printed product with an identical array of stitching locations, each stitching location receiving a stitch or being punched through. A hole is punched in the first section at a first stitching location. A hole is punched in the second section at a second stitching location. The stitching location arrays of the first and second sections are aligned with each other. Stitching material of a first stitch is passed through the hole in the second section at the second stitching location and the first section is stitched with the first stitch at the second stitching location. A printing press is also provided.

7 Claims, 5 Drawing Sheets

(56) References Cited

U.S. PATENT DOCUMENTS

| | | | | |
|---|---|---|---|---|
| 7,775,512 | B2 | 8/2010 | Guaraldi et al. | |
| 7,857,298 | B2 | 12/2010 | Schlough et al. | |
| 8,128,080 | B2 | 3/2012 | Curley et al. | |
| 2005/0152725 | A1* | 7/2005 | Mochizuki | B26F 1/04 399/410 |
| 2007/0101881 | A1 | 5/2007 | Bitzl et al. | |
| 2009/0127763 | A1 | 5/2009 | Cossette | |
| 2010/0320673 | A1 | 12/2010 | Takata | |
| 2011/0259224 | A1 | 10/2011 | Reardon | |

* cited by examiner

STITCHING SECTIONS OF A TABLOID NEWSPAPER

This claims the benefit of U.S. Provisional Application No. 61/747,754 filed Dec. 31, 2012, and hereby incorporated by reference herein.

The present invention relates generally to printing presses and more particularly to stitching and stapling books, magazines, sections, papers or newspapers.

BACKGROUND

Tabloid newspapers are known in the art. In contrast to broadsheet newspapers, tabloid newspapers or other tabloid style products are not folded in half longitudinally by a former board. Instead, tabloid products may be folded in half by a jaw cylinder or other type of folding device. As a result, tabloid products usually include one section as opposed to multiple sections seen in broadsheet newspapers.

U.S. Publication No. 2009/0127763, hereby incorporated by reference herein, discloses a method for making a tabloid printed product. At least one web of material is slit to define at least two ribbons. One ribbon is folded longitudinally while the second ribbon remains unfolded. Both ribbons are cut into sheets and combined. At least one unfolded sheet is folded around sheets from the longitudinally folded ribbon.

U.S. Publication No. 2011/0259224, hereby incorporated by reference herein, discloses a 3 by 2 tabloid printing press which includes a plate cylinder having a straight across plate lock-up. The 3 by 2 tabloid printing press can produce three webs which can be combined and folded together to form a single tabloid product.

Stitchers, stitching and stapling devices and stitching and/or stapling books, magazines, sections, papers or newspapers is known in the printing arts. Individual sheets can be bound or held together by an in-line application of glue or by stitching the sheets together with wire staples. Stitchers may be incorporated at different positions in a production line depending upon the type of production. A saddle stitcher, for example, may collate printed products and bind them together using stitches, such as staples. The printed products are opened to the center fold and collaged by feeders onto a saddle chain to be conveyed past a stitching mechanism. The printed products are bound together and removed from the saddle conveyor for further processing.

Stitchers operating a full production speeds may be incorporated into folders. For example, stitchers may work together with closing heads that are fitted on tucker blade cylinders. Two or three revolving closing heads with shaping wheels shape an automatically fed staple wire into U shaped staples after it has been cut. When the product comes into contact with the folding cylinder the cam-controlled stitcher heads drive the staples through the sheets on the closing heads which automatically bend the staple legs over to secure the sheets. This type of stitching is often used with tabloid style products. Stitchers and stitching heads may also be arranged to wire-stitch sheets or products on conveying lines.

U.S. Pat. No. 6,962,280, hereby incorporated by reference herein, discloses a rotary stitching device having a wire supply, a cutting device for cutting a wire section from the wire supply and a rotating forming wheel having a forming wheel axis of rotation, the rotating forming wheel receiving the wire section.

U.S. Pat. Nos. 7,588,240, 7,775,511 and 7,775,512, hereby incorporated by reference herein, disclose saddle stitching devices for moving unbound printed products on a saddle conveyor past stitching devices for stitching the printed products.

U.S. Pat. No. 7,857,298, hereby incorporated by reference herein, disclose a stitcher carriage having a center of gravity. The driving force of an operating link of the stitcher carriage is applied through the center of gravity to reduce wear and stress on the carriage components.

U.S. Pat. No. 8,128,080, hereby incorporated by reference herein, discloses a spring loaded corrugated stitching head for stitching books or printed products.

BRIEF SUMMARY OF THE INVENTION

The present invention provides a method for forming a printed product. The method includes the steps of:

- providing a first section and a second section of the printed product with an identical array of stitching locations, each stitching location receiving a stitch or being punched through;
- punching a hole in the first section at a first stitching location;
- punching a hole in the second section at a second stitching location;
- aligning the stitching location arrays of the first and second sections with each other;
- passing stitching material of a first stitch through the hole in the second section at the second stitching location; and
- stitching the first section with the first stitch at the second stitching location.

Additional features of the present invention may be provided in further preferred embodiments. These features may be provided alone or in combination with another. Additional features include:

- at each aligned stitching location only one section receives a stitch, the remaining sections each receive a punch at the corresponding aligned stitching location;
- the first and second sections are stitched at the same time, the second section receiving a stitch at the first stitching location;
- the first and second sheets or sections are stitched at different times or in repeat steps;
- folding the stitched sections with an inline folding device;
- each section receives a plurality of stitches at a plurality of stitching locations and the remaining stitching locations are punched through; and
- each section is stitched at two stitching locations and the remaining stitching locations are punched through.

The present invention also provides a printing press forming a printed product. The printing press includes at least one printing unit printing a plurality of sections, each section including an identical array of stitching locations, each stitching location receiving a stich or being punched through, a punching device for punching a hole in each of the sections, at least one stitching location being punched through in each section and at least one stitching location able to receive a stitch in each section and a stitching device for stitching the plurality of sections at respective stitching locations, the array of stitching locations for the sections being aligned so for a respective stitching location, one section is stitched and the remaining sections are punched through.

Additional features of the present invention may be provided in further preferred embodiments. These features may be provided alone or in combination with another. Additional features include:

each section receives at least one stitch in a respective stitching location, the remaining stitching locations for that section are punched through;

a first stitch stiches a first section at a first stitching location and stitching material of the first stitch passes through holes at the first stitching location in the remaining sections that are not stitched;

a cutting cylinder cutting the web or ribbons into sheets; a collect cylinder collecting sheets to form sections and a conveyor for transporting sections downstream;

each section receives two or more stitches;

a folding device is located downstream of the punching device, the folding device may be a quarterfolder or a chopper folder and/or an inline folder;

a controller for controlling the placement of stitches each section receives at the respective stitching locations;

a stitch only stitches one collected section together at the stitching location;

a stitching head of the stitching device passes the stitching material through at least one hole punched in at least one section before stitching another section;

the collected sections are nested inside one another;

the collected sections are combined together when the collected sections are stitched;

the collected sections are stitched at a same time;

the sections are flat when the sections are punched and stitched; and the sections are folded after the sections are stitched.

BRIEF DESCRIPTION OF THE DRAWINGS

A preferred embodiment of the present invention will be elucidated with reference to the drawings, in which.

DETAILED DESCRIPTION OF PREFERRED EMBODIMENTS

Figure 1:
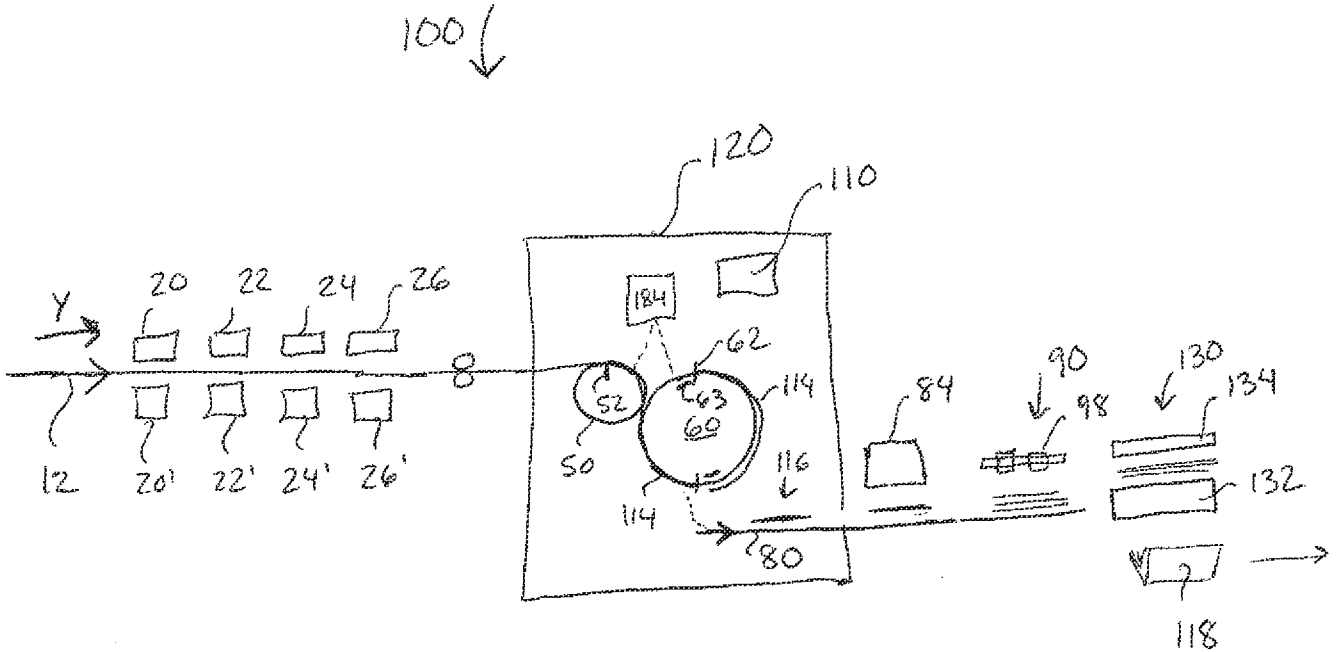
FIG. 1 shows a web printing press in accordance with an embodiment of the present invention.

Digital printing presses provide great flexibility in the printing arts. Digital printing presses do not require the use of printing plates and thus have a quicker and less expensive turnaround time than traditional lithographic and flexographic printing presses. The flexibility of digital printing may not be maximized when digital printing units replace traditional printing units previously known in the art because downstream processing equipment is designed to accommodate the limitations associated with traditional offset printing cylinders. For example, when multiple sets of different pages are produced digitally (also known as "collect mode") or when multiple sets of pages with different subject matter are selectably sequenced onto one web, the associated downstream folders cannot accumulate or "collect" a varying number of products in the traditional manner. Consequently, the capabilities of a digital printing press may be reduced when using traditional collect mode folders.

In accordance with the present invention, a sectioned tabloid newspaper may be produced. A printing press according to the present invention is configured to produce printed products such as newspapers, for example, tabloid newspapers, from a web or sheeter. The pages may be printed digitally in any desired sequence and include a plurality of sections. The number of sections per newspaper and the number of pages in each section may be variable in accordance with a preferred embodiment of the present invention.

Tabloid newspapers printed on a digital printing press are produced with the newspaper pages laid out across the length of the web, along the direction of web travel. A former board may slit a tabloid printed web in half thereby defining two web ribbons, for example. The web ribbons are typically combined with each other, cut by a pair of cutting cylinders, then tucked into a jaw folder. The jaw fold forms a spine of the tabloid newspaper. As result, known tabloid products often consist of one section having a single fold, the spine. Other types of folders, for example, bar folders, quarterfolders or chopper folders may also be used.

Digital print engines may print pages of a desired final product in a sequence on the web so final products may be made on a copy per copy basis in contrast to traditional offset printing methods in which a section or portion of a final product is made in multiples and the different sections are later combined with each other. For example, when printing a newspaper, each page of the newspaper may be digitally printed on the web before the digital print engines start printing a second copy or version of the newspaper, thereby forming one complete newspaper from sequential images on the web. The digital print engines can begin printing the second newspaper without stopping the press to change folder modes.

In addition, if, for example, newspaper sections are desired, an entire first section may be digitally printed on the web in sequence before second, third and further successive sections begin printing, regardless of the number of pages in the different sections. In another alternative, different sections may be printed in a desired sequence and formed simultaneously, regardless of the number of pages desired in each section. Thus, different sections can be digitally printed at any time and in any order as desired by the press operator. Further flexibility provided by the digital print engines also provides for different sections to be printed in duplicates or multiples as desired. For example, a first newspaper section A, may be collected at each gripping location on a collect cylinder and folded off into a jaw cylinder or stacked on a conveyor. A second newspaper section B may then be collected at each gripping location and folded into the jaw cylinder or stacked on a conveyor.

FIG. 1 shows a web printing press 100 including a folder 120 in accordance with the present invention. Printing press 100 includes a plurality of printing units 20, 20', 22, 22' 24, 24', 26, 26', for example, digital print engines located on either side of web 12. Printing units 20, 20', 22, 22' 24, 24', 26, 26' print on both sides of web 12 as web 12 travels in a direction Y. Digital print engines may include direct imaging print units, ink jet printers or laser printers. The number of digital print engines used may vary as desired.

Figure 2:
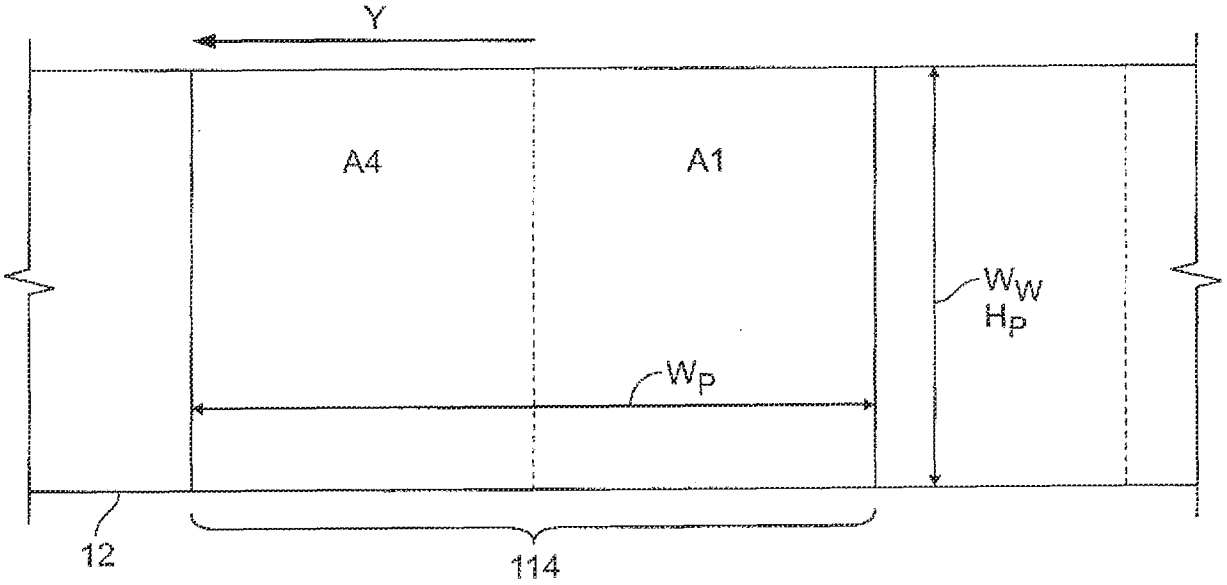
FIG. 2 shows a tabloid sheet.

As discussed above, sheets are printed with images printed along the length of web 12, in the direction of web travel Y, thereby producing a panorama sheet 114. (See FIG. 2). As a result, panorama sheet 114 has a height $H_P$ equal to a width of web 12 ($W_W$) and a width ($W_P$) which is two pages wide. Pages are identified as A1 and A4. The other side panorama sheet 114 includes pages A2 and A3, respectively. In another embodiment, the web may have a web width that is wider than a height of the panorama sheets thereby accommodating multiple rows of panorama sheets.

Web 12 enters folder 120 and is cut into sheets or printed products by a cutting cylinder 50 having cutting blade 52. Folder 120 includes a one-around cutting cylinder 50, as known in the art and a two around collect cylinder 60. A controller 110 may be provided to control components of folder 120 and/or press 100. Other embodiments and configurations of folder 120 are also possible. For example, any other format cutting cylinder 50 and collect cylinder 60. A transfer cylinder may also be provided.

Sheets 114 are cut from web 12 and collected on collect cylinder 60. Collect cylinder 60 includes two grippers 62, which may also be any type of sheet gripping device, and two cutting rubbers to counteract blade 52. Collected sheets 114 are released from collect cylinder 60 and deposited onto a conveyor 80 or other receiving location.

Collected sheets 114 form a stacked, flat section 116. Section 116 may be an entire newspaper, a section of an entire newspaper or any other desired array of sheets.

When press 100 is running in straight mode, a pin 62 on collect cylinder 60 may collect an entire newspaper or an entire newspaper section as desired. The entire section or newspaper will then be released to conveyor 80 thereby forming stack 116.

When press 100 is running in collect mode, each pin 62 on cylinder 60 may gather a section of a newspaper, so two sections are being collected on cylinder 60 at the same time. The sections may be identical or different depending upon the printing configuration.

In accordance with the present invention, each sheet 114 is punched with a desired punching array. Each sheet 114 may be punched individually, for example, by a punching device 184 or 84 or a plurality of sheets may be punched together. Punching device 184 may punch sheets before sheets 114 are cut from web 12, prior to collecting sheets 114 on collect cylinder 60, or after sheets 114 are collected on collected cylinder 60.

If sheets 114 are forming a single newspaper section 116, the section or stack 116 of sheets may be punched together, for example, while stack is on conveyor 80 by punching device 84. Punching the stack 116 at the same time works when each sheet needs to have the same, desired punching array.

When each stack 116 includes a plurality of sections, it is desirable to punch each sheet prior to forming stack 116, for example, while sheets 114 are collected at pin 62 or before or after sheets 114 are cut from web 12. In this instance, punching device 184 may be located alongside or downstream of cutting cylinder 50 and collect cylinder 60. Sheets 114 may also be punched before or after sheets 114 are collected into sections 116, for example, before or after collect cylinder 60. However, other embodiments may also be realized.

Figure 3:
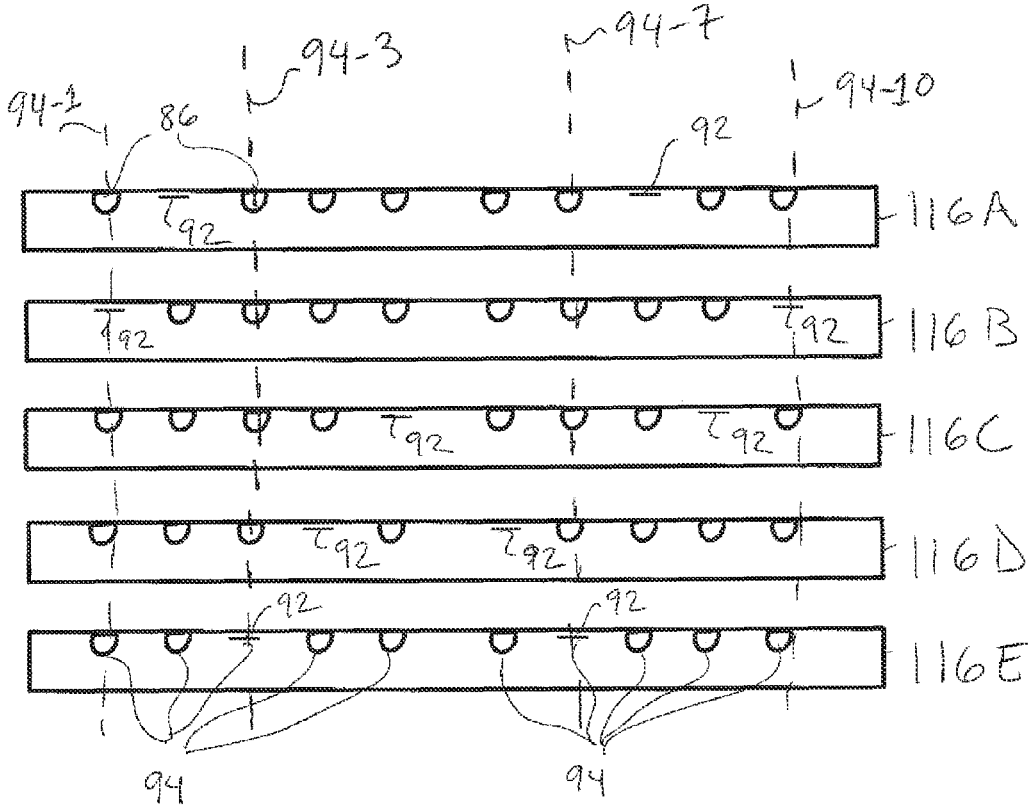
FIGS. 3 and 4 show an array of stitches and punches in a tabloid sheet and newspaper in accordance with the present invention.

As shown in FIG. 1, a stack 116 is punched by a punching device 84. Punching device 84 punches a desired array of holes 86 or punches into each stack 116 (A to E) as shown in FIG. 3. Punching device 84 may be located in a plurality of locations. A punched stack 116 may be collected with other punched stacks on conveyor 80. As shown in FIG. 1, the stacks 116 are then transported past stitching device 90. Stitching device 90 may be, for example, an inline, ten head stitcher which has ten possible stitching locations 94 (FIG. 3). Stitching device 90 stitches sections 116 in the manner described below with further reference to FIGS. 3 and 4. Stitched sections 116 may then be further transported downstream for additional processing and/or may be folded into newspapers 118 by a folding device 130.

Folding device 130 may be a quarter folder or chopper folder as known in the art. Chopper folding device 130 may include a chopper blade 134 and folding rollers 132. A stack or sections 116 are pushed between folding cylinders 132 by chopper blade 134 to form a spine of the newspaper 118. In another preferred embodiment, stacks 116 may be folded prior to stitching. Thus, stacks may be transported past stitching device 90 along a saddle conveyor, for example.

Hoppers, stackers, collators, gripper conveyors, saddle conveyors or other processing and finishing equipment may be used to combine the a plurality of sections 116 to form newspaper 118 or to combine a plurality of newspapers 118 as desired.

Figure 4:
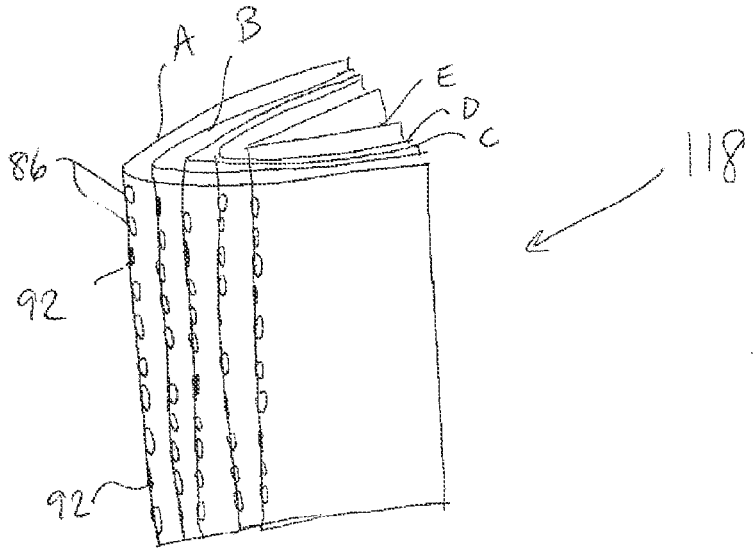

As shown in FIGS. 3 and 4, a tabloid newspaper 118 is formed from five sections 116 (A to E). FIG. 3 shows the spine or folded edge of each section and the array of stitching locations 94 (1 to 10) including stitches 92 and punches 86 for each section 116 (A to E). FIG. 4 shows a final newspaper 118 with each section 116 folded therein and the array of punches 86 and stitches 92.

At each stitching location 94, stack or section 116 will be stitched with a stitch 92 or was previously punched by punching device 84 thereby leaving a punch or hole 86. As shown, each section 116A, 116B, 116C, 116D, 116E receives two stitches 92 to bind the respective section together and thus is punched eight times, shown by punches 86. The two stitches 92 occur in a stitching location 94 where the sections 116A, 116B, 116C, 116D, 116E are not punched through. By providing an array of holes/punches, each section 116 is stitched together by two stitches 92, but none of the sections 116 are stitched to another section 116. Alternative stitching and punching arrays may also be preferred. For example, in a two section product each section may be stitched five times and punched five times.

The array of stitching locations for each section are similar or identical. The number of stitching locations is the same and the spacing of the stitching locations is similar or identical. The arrays of each section may be aligned, for example, when the sections are stacked. With reference to FIG. 3, when sections 116A, 116B, 116C, 116D, 116E are stacked on top of each other, one can see through holes at stitching location 94-7 of sections 116A to D and see the stitching location of section 116E when looking down at the sections. While there may be some variation in the layout or arrangement of the stitching location arrays, the differences may not impede the ability of the stitching material to pass through holes in punched sections and stitch the remaining section.

Stitching heads 98 (FIG. 1) bypass stitching locations 94 which have been punched through and place a stitch 92 at the desired stitching location 94, sans punch 86. Stitching material of the stitching device 90 passes through a plurality of holes 86 in sections 116 before reaching the desired stitching location 94 to place a stitch. For example, with reference to section 116E in FIGS. 3 and 4, stitches 92 were received in section 116E at two stitching locations, 94-3 and 94-7. To accomplish this stitching, stitching material was run through a hole or punch in each of sections 116 A to D at stitching locations 94-3 and 94-7 before reaching punched stitching locations 94-3 and 94-7. Furthermore, with regard to section 116B, for example, stitches 92 were placed at stitching locations 94-1 and 94-10. It is noted, that a plurality of holes or punches 86 must be present at stitching locations 94-1 and 94-10 for subsequent sections 116 C to E so underlying sections 116C to 116E are not also stitched to section 116B. The stitching material does not only pass through punches 86 on outer section 116A, but also passes through holes in inner sections 116C to E so only sheets in section 116B are bound together. If inner sections 116 C to E did not have punches 86 at stitching locations 94-1, 94-10, sections 116 C to E would also be stitched to section 116B.

An advantage of the present invention occurs during stitching and stapling. For example, if each section 116A, 116B, 116C, 116D, 116E is punched and collected onto a conveyor 80, the sections 116 of newspaper 118 can be stitched at the same time with the same stitcher 90 on the finishing line thereby expediting the stitching process. One pass through stitcher 90 is sufficient to stitch each of the five sections.

Another advantage of the present invention occurs when tabloid or printed products are formed using sheets instead of folded webs or ribbons. When sheets are used to form the tabloid newspaper, singular sheets 114 may be stitched together to bind the newspaper together as opposed to folding the sheets to form the spine. A cover sheet may be folded around the final stitched sections.

Figure 5:
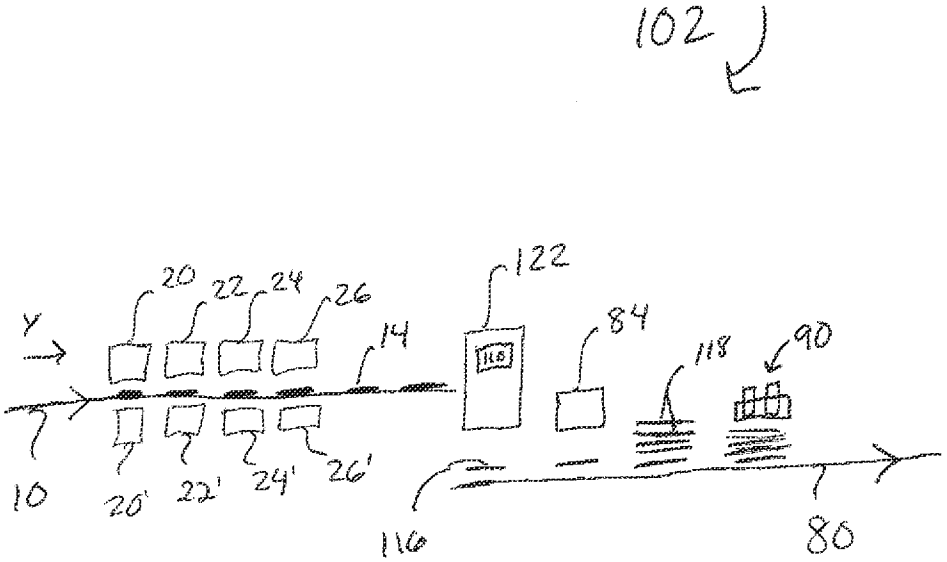
FIGS. 5 and 6 show a sheet fed printing press in accordance with further embodiments of the present invention.

FIG. 5 shows a sheet feed printing press 102 in accordance with a further embodiment of the present invention. Elements and components similar to those shown and described in FIG. 1 are represented by the same reference numerals and are not described again. A hopper 122, for example, collects printed sheets from tape conveyor 10 after sheets 114 are printed. Sheets 114 may be tabloid, panorama sheets as shown and described in FIG. 2 having a width of $W_P$ or sheets 114 may be single page sheets having a width of $W_{(P/2)}$. Hopper 122 deposits sections 116 onto conveyor 80. Each section 116 is punched by punching device 84 then stitched by stitching device 90 while sheets are unfolded or flat. In this embodiment, the hopper is depositing accumulated sheets onto conveyor 80 so each sheet in a single section 116 is punched at the same time. Sections 116 may be further collated with additional sections 118 to form a complete newspaper prior to reaching stitching device 90. In this way, a complete product including sections 116, 118 may be stitched by device 90 in one pass.

Figure 6:
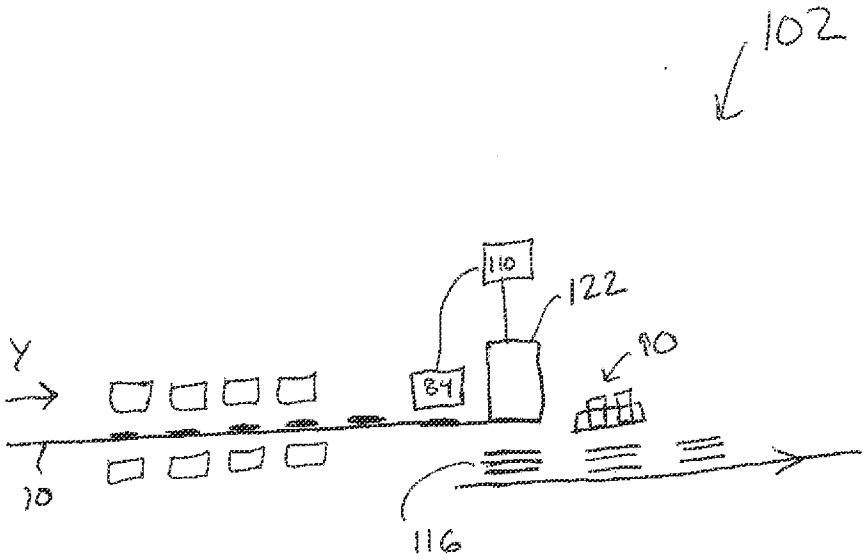

FIG. 6 shows another variation of the sheet fed press shown in FIG. 5. In FIG. 6, punching device 84 is located upstream of hopper 122. Thus, sheets 114 are punched before being collected or accumulated in hopper 122. As a result, hopper 122 may deposit a complete newspaper, for example, when running in straight mode, onto conveyor 80. The newspaper is then stitched by stitcher 90 and sent further downstream for processing, which may include inserting or folding. In contrast to the embodiment shown in FIG. 5, each sheet 114 is punched individually instead of in a stack 116.

Single page sheets ($W_{P/2}$) may run through the presses shown in FIGS. 5 and 6. Single page sheets may be punched by punching device 84 and stacked together to form sections 116. Sections 116 may be stitched by an inline stitching device 90 at any point downstream and subsequently bound or covered with a panorama sheet to form a newspaper 118. Single page sheets may bypass downstream folding equipment 130.

An advantage of the present invention includes passing a multi-sectioned product past a single stitching device once in order to quickly stitch the printed product and reduce the downstream processing time. In this manner, the capabilities of digital printing presses may be maximized by for example, producing, multi-sectioned tabloid newspapers and maintaining high press speeds even through downstream processing equipment.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for forming a printed product comprising the steps of:

providing a first section and a second section of the printed product with an identical array of stitching locations, each stitching location receiving a stitch or being punched through;

punching a hole in the first section at a first stitching location;

punching a hole in the second section at a second stitching location;

aligning the stitching location arrays of the first and second sections with each other;

passing stitching material of a first stitch through the hole in the second section at the second stitching location; and stitching the first section with the first stitch at the second stitching location.

2. The method for forming a printed product as recited in claim 1 wherein at each aligned stitching location only one section receives a stitch, the remaining sections each receive a punch at the corresponding aligned stitching location.

3. The method for forming a printed product as recited in claim 1 wherein the first and second sections are stitched at the same time, the second section receiving a stitch at the first stitching location.

4. The method for forming a printed product as recited in claim 1 wherein the first and second sheets or sections are stitched at different times or in repeat steps.

5. The method for forming a printed product as recited in claim 1 further comprising the step of folding the stitched sections with an inline folding device.

6. The method for forming a printed product as recited in claim 1 wherein each section receives a plurality of stitches at a plurality of stitching locations and the remaining stitching locations are punched through.

7. The method for forming a printed product as recited in claim 6 wherein each section is stitched at two stitching locations and the remaining stitching locations are punched through.

* * * * *